US005466504A

United States Patent [19]

Gavin et al.

[11] Patent Number: 5,466,504

[45] Date of Patent: Nov. 14, 1995

[54] FIBROUS GLASS INSULATION ASSEMBLY

[75] Inventors: Patrick M. Gavin, Newark; Jean E. Schelhorn, Granville; David P. Aschenbeck, Newark; Carl R. Strauss, Granville, all of Ohio

[73] Assignee: Owens-Corning Fiberglas Technology, Inc., Summit, Ill.

[21] Appl. No.: 236,068

[22] Filed: May 2, 1994

[51] Int. Cl.[6] ..... B32B 1/06

[52] U.S. Cl. ..... 428/74; 52/406.1; 52/406.2; 52/406.3

[58] Field of Search ..... 428/74, 69, 913; 52/406.1, 406.2, 406.3

[56] References Cited

U.S. PATENT DOCUMENTS

| | | | |
|---|---|---|---|
| 3,782,081 | 1/1974 | Munters | 55/278 |
| 4,040,804 | 8/1977 | Harrison | 55/158 |
| 4,668,551 | 5/1987 | Kawasaki | 428/69 |
| 4,749,392 | 6/1988 | Aoki | 55/587 |
| 5,018,328 | 5/1991 | Cur et al. | 52/406 |
| 5,114,003 | 5/1992 | Jackisch et al. | 206/204 |
| 5,130,018 | 7/1992 | Tolman et al. | 210/172 |
| 5,137,747 | 8/1992 | Maladain et al. | 427/4 |
| 5,316,816 | 5/1994 | Sextl et al. | 428/74 |

*Primary Examiner*—Alexander S. Thomas
*Attorney, Agent, or Firm*—Ted C. Gillespie; C. Michael Gegenheimer; Richard D. Emch

[57] ABSTRACT

An improved fibrous glass insulation assembly is disclosed. The insulation assembly includes at least one fibrous glass body enclosed by a vapor barrier plastic outer layer or by a bag or package. A desiccant is provided adjacent the fibrous glass body to remove moisture.

15 Claims, 2 Drawing Sheets

FIBROUS GLASS INSULATION ASSEMBLY

BACKGROUND OF THE INVENTION

Glass fiber insulation assemblies are known in the art. Often these assemblies include a fibrous glass body and an outer plastic layer. Sometimes the outer layer is removed prior to installation in the field and other times, the entire encapsulated insulation assembly is installed in the field.

It has been found that, if the covered fibrous glass insulation body is stored for a length of time, for example six weeks, the recovery rate when the assembly is unrolled or uncompressed diminishes. A major cause of such a reduction in recovery rate is the absorption of moisture into the fibrous glass body.

The present invention is directed to an improved fibrous glass insulation assembly in which moisture is removed or reduced when the assembly is stored.

SUMMARY OF THE INVENTION

The present invention is directed to an improved fibrous glass insulation assembly having a fibrous glass body, for example a glass fiber wool body. The body is encapsulated or enclosed by a plastic outer layer. In other embodiments, a plurality of fibrous glass batts or bodies are received in a bag or package. A desiccant is positioned within the outer plastic layer adjacent the fibrous glass body or within the package for removing moisture from such fibrous glass body.

DESCRIPTION OF THE PREFERRED EMBODIMENTS

Figure 1:
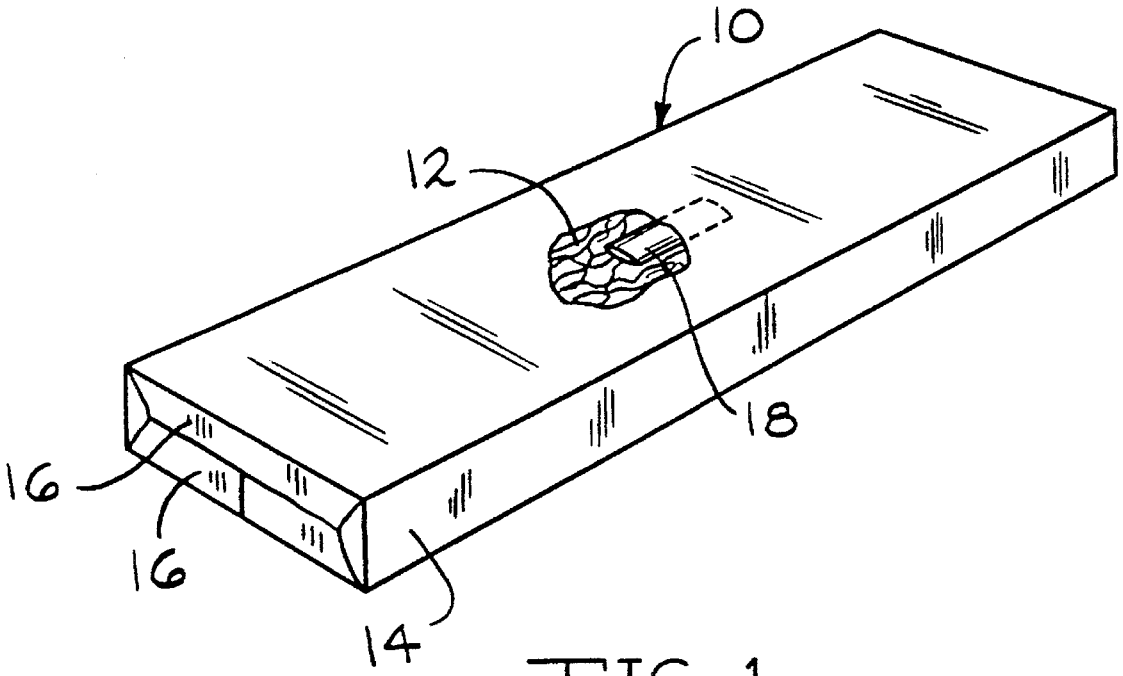
FIG. 1 is a perspective view, with parts broken away, of an improved fibrous glass insulation assembly, according to the present invention.

An improved non-evacuated fibrous glass insulation assembly, according to the present invention is indicated by the reference number 10 in FIG. 1. The insulation assembly 10 includes a fibrous glass batt or body 12 which is enclosed by a plastic outer layer 14. While the body 12 is shown as a fibrous glass wool rectangular body, the body may have several configurations. The body may be elongated and rolled and the entire roll enclosed by the plastic outer layer.

Similarly, while the plastic outer layer 14 is preferably a polyethylene layer, other types of plastics can be used. The plastic outer layer 14 includes sealed end flaps 16. Again, other types of end configurations may be used in the insulation assembly 10, according to the present invention. In some embodiments end flaps are not provided.

In the present embodiment, the plastic outer layer 14 is a polyethylene layer having a thickness of between 0.3 mil and 3 mil, thereby forming a vapor barrier, with respect to the fibrous glass body 12. High density polyethylene is preferred, as it is a better moisture barrier than low density polyethylene.

A desiccant is positioned within the outer plastic layer 14, adjacent the fibrous glass body 12. In the FIG. 1 embodiment, the desiccant comprises a plurality of pouches 18. The pouches 18 are formed from moisture permeable materials. In the present embodiment, the pouches 18 are constructed of a moisture permeable paper. Desiccants are contained within the pouches 18. One preferred desiccant is a granular anhydrous calcium sulfate ($CaSO_4$) which is sold under the trademark "DRIERITE" by W. A. Hammond Drierite Co., Xenia, Ohio. Desiccants which are used in accordance with the present invention are listed below in Table I.

TABLE I

LIST OF DESICCANTS $CaSO_4$ anhydrous
$CaCl_2$ fused
$CaCl_2$ granular
$P_2O_5$
CaO
BaO
$Al_2O_3$
NaOH sticks
KOH fused
$H_2SO_4$
$CaBr_2$
$ZnCl_2$
Ba $(ClO_4)_2$
$ZnBr_2$
Molecular Sieves Sufficient desiccant pouches 18 are provided to reduce the relative humidity of the fibrous glass body 12.

Figure 2:
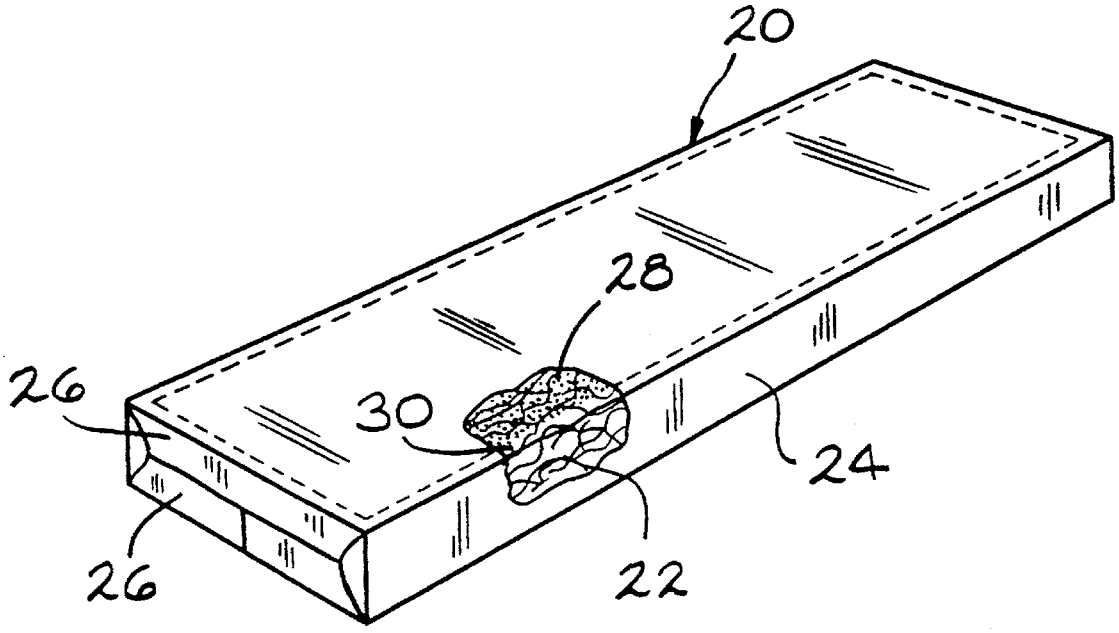
FIG. 2 is a perspective view, similar to FIG. 1 of another embodiment of an insulation assembly, according to the present invention.

Another embodiment of a fibrous glass insulation assembly, according to the present invention, is indicated by the reference number 20 in FIG. 2. The fibrous glass insulation assembly 20 includes a fibrous glass body 22 and plastic layer 24 having end flaps 26. The end flaps 26 are sealed and the plastic outer layer 24 forms a vapor barrier relative to the fibrous glass body 22. The fibrous glass insulation assembly 20 also includes a desiccant. In the present embodiment the desiccant comprises a desiccant layer 28. In the present embodiment, the desiccant layer 28 is sprayed on an upper surface 30 of the fibrous glass body 22. The desiccant layer 28 is comprised of anhydrous calcium sulfate ($CaSO_4$). Other desiccants listed above in Table I may be utilized to form the desiccant layer 28.

Figure 3:
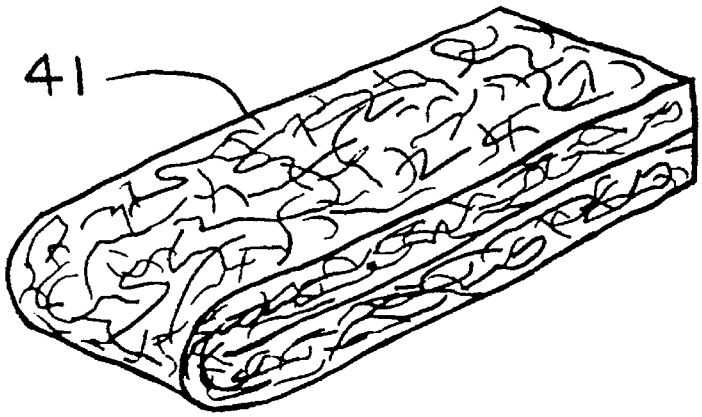
FIG. 3 is a perspective view of a fibrous glass insulation batt, which has been folded.
Figure 4:
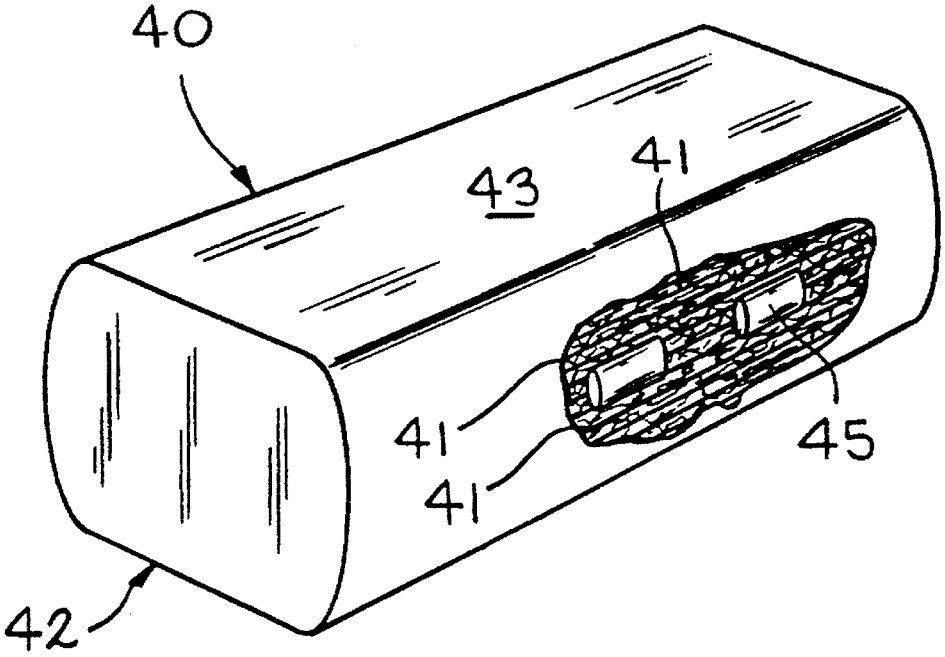
FIG. 4 is still another embodiment of an insulation assembly, according to the present invention.

Referring to FIGS. 3 and 4, a fibrous glass insulation assembly, according to the present invention is indicated by the reference number 40. A fibrous glass batt or body 41 is shown in FIG. 3. The batt 41 is uncovered and has been folded in half. The batt 41, shown in FIG. 3 is in an uncompressed state.

The assembly 40 includes a plurality of fibrous glass batts 41 which have been compressed and positioned with a package 42. In the present invention the package 42 comprises a plastic bag or outer layer 43. The plastic bag 43 encloses the plurality of fibrous glass batts 41.

A desiccant is positioned within the bag 43. In the FIG. 4 embodiment, the desiccant comprises a plurality of pouches 45. The pouches 45 are formed from moisture permeable materials, such as a moisture permeable paper. Desiccants are contained within the pouches 45. A preferred desiccant is granular anhydrous calcium sulfate ($CaSO_4$). Other desiccants which may be used are listed above in Table I.

When the insulation assembly 40 is taken to the job site, the bag 43 is removed and the batts 41 recover. It is not unusual for the recovered thickness of the batts 41 to be five or six times the thickness of the compressed batts 41.

The desiccant pouches 45 lower the relative humidity within the bags 43 during storage.

It has been found that the use of a desiccant in a fibrous glass insulation assembly unexpectedly improves recovery performance, namely, the recovered thickness of the assembly upon opening a compressed assembly, after a long-term storage. The recovery improvement is often 15 percent to 18 percent better than assemblies which do not include desiccants.

Many revisions may be made to the above described preferred embodiments without departing from the scope of the present invention or from the following claims.

We claim:

1. An improved fibrous glass insulation package comprising, a fibrous glass body in a recoverable compressed state, a plastic outer layer enclosing said fibrous glass body and a desiccant positioned within said plastic outer layer adjacent said fibrous glass body, said desiccant being adapted for removing a sufficient amount of moisture from said fibrous glass body to improve the recovery performance of said fibrous glass body from a compressed state to an uncompressed state.

2. An improved fibrous glass insulation package, according to claim 1, wherein said plastic outer layer comprises a vapor barrier layer.

3. An improved fibrous glass insulation package, according to claim 2, wherein said desiccant comprises a plurality of desiccant pouches constructed of moisture permeable material having desiccant positioned within said pouches.

4. An improved fibrous glass insulation package, according to claim 3, wherein said desiccant comprises a granular anhydrous calcium sulfate.

5. An improved fibrous glass insulation package, according to claim 3, wherein said plastic layer comprises a polyethylene film having a thickness between 0.3 mil and 3 mil.

6. An improved fibrous glass insulation package, according to claim 5, wherein said desiccant layer comprises anhydrous calcium sulfate.

7. An improved fibrous glass insulation package, according to claim 2, wherein said desiccant comprises a desiccant layer positioned adjacent said fibrous glass body.

8. An improved fibrous glass insulation package, according to claim 1, wherein said outer layer comprises a bag, including a plurality of fibrous glass bodies within said bag.

9. An improved fibrous glass insulation package, according to claim 1, wherein said fibrous glass body has opposite ends and said plastic outer layer includes sealed end flaps.

10. An improved fibrous glass insulation package, according to claim 1, wherein said fibrous glass body has opposite ends and said plastic outer layer is free of end flaps.

11. An improved fibrous glass insulation package, according to claim 1, wherein said fibrous glass body is in roll form.

12. An improved fibrous glass insulation package, according to claim 1, wherein said fibrous glass body is folded.

13. An improved fibrous glass insulation package, according to claim 1, wherein said fibrous glass body is in batt form.

14. An improved fibrous glass insulation package comprising, a fibrous glass body in a recoverable compressed state, a plastic outer layer fully enclosing said fibrous glass body and a desiccant positioned within said outer layer adjacent said fibrous glass body, said desiccant being adapted for removing a sufficient amount of moisture from said fibrous glass body to improve the recovery performance of said fibrous glass body from a compressed state to an uncompressed state, said plastic outer layer forming a vapor barrier and said fibrous glass body comprising a glass wool.

15. An improved fibrous glass insulation package comprising a plurality of fibrous glass baits, an outer package enclosing said bares and a desiccant positioned within said outer package adjacent said baits, each of said baits being in a recoverable compressed state, said desiccant being adapted for removing a sufficient amount of moisture from said baits to improve the recovery performance of each of said baits from a compressed state to an uncompressed state.

* * * * *